United States Patent [19]

Maurer et al.

[11] 3,931,371

[45] Jan. 6, 1976

[54] ATTEMPERATOR

[75] Inventors: Erich Maurer, Oberhausen; Herbert Fangrat, Bottrop, both of Germany

[73] Assignee: Babcock & Wilcox Limited, London, England

[22] Filed: July 22, 1974

[21] Appl. No.: 490,831

[30] Foreign Application Priority Data

July 25, 1973 Germany ..... 2337738

[52] U.S. Cl. ..... 261/116; 122/487; 261/DIG. 10; 261/DIG. 13; 261/130

[51] Int. Cl. ..... F22g 5/12

[58] Field of Search .... 261/DIG. 76, 116, 76, 78 A, 261/DIG. 13, DIG. 10; 122/487, 459; 55/237, 238, 257

[56] References Cited

UNITED STATES PATENTS

| | | | |
|---|---|---|---|
| 2,523,126 | 9/1950 | Long | 261/78 A |
| 2,642,150 | 6/1953 | Dautrebande | 261/76 |
| 2,990,031 | 6/1961 | Michael | 261/116 |
| 3,121,127 | 2/1964 | Hedin | 261/116 |
| 3,177,634 | 4/1965 | Latham | 261/116 |
| 3,219,483 | 11/1965 | Goos | 261/DIG. 10 |
| 3,318,589 | 5/1967 | Herp | 122/487 |
| 3,559,627 | 2/1971 | Rawdon, Jr. | 122/487 |
| 3,646,728 | 3/1972 | Holler | 55/257 |
| 3,732,851 | 5/1973 | Self | 122/487 |

FOREIGN PATENTS OR APPLICATIONS

| | | | |
|---|---|---|---|
| 1,013,660 | 1962 | Germany | 261/116 |
| 1,421,337 | 1956 | Germany | 261/116 |

*Primary Examiner*—Tim R. Miles
*Assistant Examiner*—Gregory N. Clements
*Attorney, Agent, or Firm*—J. Maguire; R. J. Edwards

[57] ABSTRACT

An upright type spray attemperator for regulating the temperature of upwardly flowing superheated vapor and comprising a vessel fitted with an inner sleeve having a side outlet at the upper end thereof and containing a deflector adjacent the outlet to collect and return water droplets for further heating and wherein the outlet is formed of perforations sized to reduce the pressure of the steam passing therethrough so as induce flashing of any entrained water droplets and insure their complete vaporization.

10 Claims, 3 Drawing Figures

ATTEMPERATOR

BACKGROUND OF THE INVENTION

This invention relates generally to apparatus for controlling superheated vapor temperature by direct contact desuperheating and more particularly to upright type attemperators which spray a cooling liquid into the vapor stream.

The known attemperators of the type under consideration have encountered difficulties in achieving complete vaporization of the liquid spray within the attemperator during conditions of low spray input. These difficulties arise from the fact that atomization of the liquid is less than optimum at low flows causing the spray being injected in the vapor stream to include relatively large drops of liquid which often do not reach saturation temperature before leaving the attemperator. Efforts to overcome these difficulties have included provisions for draining accumulated liquid from the attemperator containment vessel and for increasing the pressure drop across the attemperator so as to induce flashing of the liquid. Both of these approaches have undesirable effects, the former results in heat loss whereas the latter creates excessive pressure drop at high load.

The prior art is exemplified by German Pat. No. 1,012,308 which discloses an upright type attemperator whose containment vessel includes a sleeve concentric with the vessel and spaced therefrom to form an annular passageway therebetween. During operation of this referenced attemperator, the liquid drops which do not reach saturation are collected in the annular passageway and drained therefrom with concomitant heat loss.

SUMMARY OF THE INVENTION

In accordance with the present invention, there is provided an attemperator comprising an upright vessel and a thermal sleeve disposed within the vessel. The inlets to the vessel and sleeve are subjacent to the outlets to accommodate an upward flow of vapor through the sleeve. A plurality of circumferentially spaced nozzles extend into the lower portion of the attemperator and are positioned to spray the cooling liquid upwardly into the vapor stream. The nozzles terminate close to the inner periphery of the sleeve thereby keeping the center free of vortices so as to facilitate the upward transport and heating of the liquid droplets and, if need be, to keep the larger drops in suspension within the vapor stream until they reach saturation temperature.

An upwardly divergent frusto-conical member forms the inlet to the sleeve and provides a barrier which acts to prevent the larger liquid drops from falling out of the sleeve.

The thermal sleeve includes an upper and a lower segment with the former having a smaller cross-sectional area so as to form a relatively large annular space between it and the vessel wherein any remaining liquid drops will be vaporized. The two segments are preferably connected by a frusto-conical transition piece.

A deflecting member forms an impact zone at the top of the sleeve and is conically shaped to promote an even distribution of steam at the sleeve outlet. The deflector base has a greater cross-sectional area than the upper end of the sleeve and is positioned so as to provide a closure thereof. Ring shaped drip ledges are provided to collect the liquid droplets and shed them toward the center of the sleeve in a direction counter to that of the vapor flow. The drip ledges are spaced along the longitudinal extent of the conical part the deflector.

The sleeve outlet is formed by a plurality of axially and circumferentially spaced perforations in the upper segment. The holes are sized to achieve sufficient vapor pressure drop therethrough to insure complete vaporization of the liquid droplets.

DESCRIPTION OF THE PREFERRED EMBODIMENT OF THE INVENTION

In the illustrated embodiment, the vapor is steam and the attemperating liquid is water. It should be understood, however, that the invention may be applied equally to other fluids.

Figure 1:
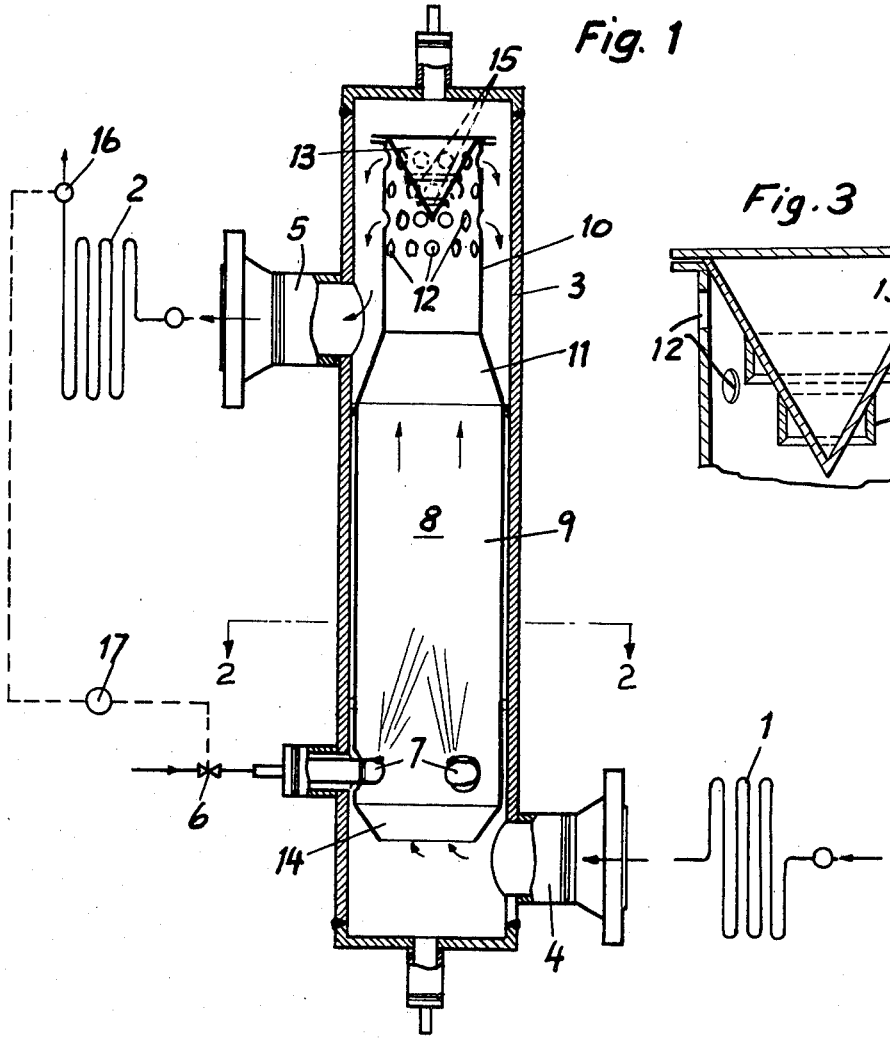
FIG. 1 is a sectional elevation view of the attemperator embodying the invention and includes a schematic representation of the heat exchange surface associated with the invention.
Figure 3:
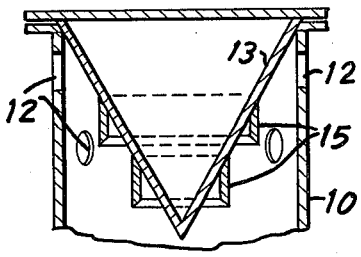
FIG. 3 is a detail view of the deflector embodied in the invention.
Figure 2:
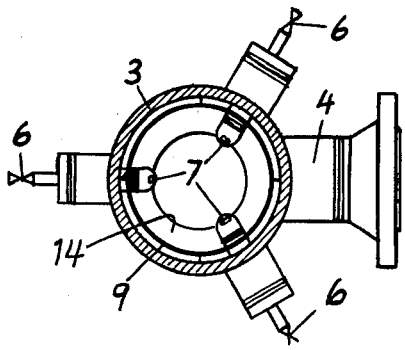
FIG. 2 is a sectional plan view taken along line 2—2 of FIG. 1.

Referring to FIGS. 1, 2, and 3 there is illustrated an upright type spray attemperator disposed between a primary and secondary superheater 1 and 2, and flow connected therewith to effectuate control of the steam temperature leaving the secondary superheater 2. The attemperator includes a cylindrical pressure vessel 3 closed at both ends and having an inlet nozzle 4 extending through a lower wall portion thereof for admitting steam from the primary superheater 1. An outlet 5 extends through an upper wall portion of vessel 3 for discharging the attemperated steam to the secondary superheater 2.

An elongated thermal sleeve 8 is secured and centered in spaced relation to the vessel 3 so as to allow a small amount of steam to pass through the annulus. The sleeve 8 includes a lower and an upper segment 9 and 10 with the latter having a smaller cross-sectional area so as to form a relatively large annular space between it and the vessel 3. The lower and upper segments are weldably inter-connected through a frusto-conical transition member 11. The upper segment 10 is provided with vertically and circumferentially spaced rows of perforations 12 extending normal to the longitudinal axis of the sleeve 8 and defining the outlet thereof. The top of sleeve 8 is fitted with a circular flange which fixedly supports the base of a conically shaped deflector 13 with the base forming a closure over the top of sleeve 8. The deflector cone extends downwardly into the upper segment 10 and terminates at a level intermediate of the top and bottom rows of perforations 12. A plurality of drip ledges 15 are spaced along the longitudinal extent of the deflector cone and project outwardly thereof, these are preferably formed with a bevelled end face. The bottom of sleeve 8 is open and is fitted with a frusto-conical member 14 divergent in the direction of steam flow and defining the inlet thereto. Three coplanar and circumferentially equispaced water spray nozzles 7 extend through the vessel and sleeve walls in a direction normal to the longitudinal axis of the attemperator and terminate at points adjacent to the sleeve inner periphery. The nozzle discharge orifices are positioned to spray the water into the vapor stream along a generally upward direction.

The cross-sectional flow area of the sleeve 8 and the perforations 12 are sized so as to obtain the required minimum pressure drop across the perforations 12 resulting in flashing of the water droplets exiting therefrom.

During operation of the vapor generator (not shown), steam is superheated by serially passing it through the primary and secondary superheaters 1 and 2. The temperature of the steam leaving the secondary superheater 2 is being maintained at a predetermined value by regulating the quantity of water being sprayed into the steam as it flows through the attemperator interposed between the primary and secondary superheaters. A steam temperature monitoring device (not shown) is located within the secondary superheater outlet header 16 and is equipped in a manner well known in the art to transmit a representative signal to a regulator 17 which actuates the control valves 6 thereby regulating the quantity of water being sprayed into the steam flowing through the attemperator.

In accordance with the invention, the steam being discharged from the superheater 1 enters the attemperator vessel 3 through a nozzle 4 whereupon it changes direction and flows upwardly as it enters the thermal sleeve inlet 14. The steam passing through the lower segment 9 is cooled by the water injected through the nozzles 7. The relatively small amount of steam which by-passes the sleeve 8 and flows upwardly through the annular space formed between the vessel and sleeve walls creates a protective thermal layer eliminating any abrupt temperature gradients to the heavy vessel wall. The water supplied to the nozzles 7 is at a pressure greater than that of the steam flowing through the sleeve segment 9 and is injected thereinto in the form of an upwardly directed spray distributed so as to substantially cover the radial cross-section of sleeve 8.

At high spray flows, atomization of the cooling water is optimized and the spray droplets are of such minute size as to easily reach saturation temperature during the upward travel through sleeve 8. The resultant pressure drop across the perforations 12 cause the saturated droplets to flash and completely evaporate as they leave the upper sleeve segment 10.

At low spray flows, atomization of the cooling water is less than optimum and the spray may contain droplets which are sufficiently large so as not to reach saturation temperature during the upward travel through sleeve 8. These larger water droplets impinge on the deflector cone 13 and are collected along the ledges 15 to be gravitated back into the sleeve 8 and become reentrained in the steam and be further heated thereby. As the droplets reach saturation temperature they are carried through the perforations 12 where the resultant pressure drop causes them to flash and become fully vaporized before exiting from the attemperator.

The novel features incorporated in the present invention, including the conical deflector, the steam flow directional change at the sleeve outlet and the enlarged annular space between the sleeve and vessel outlets, achieve substantially complete vaporization of the spray water while maintaining reasonable pressure drop throughout the operating range of the vapor generator.

While in accordance with the provisions of the statutes there is illustrated and described herein a specific embodiment of the invention, those skilled in the art will understand that changes may be made in the form of the invention covered by the claims, and that certain features of the invention may sometimes be used to advantage without a corresponding use of the other features.

The embodiments of the invention in which an exclusive property or privilege is claimed are defined as follows:

1. An attemperator comprising an upright vessel, a sleeve disposed within the vessel in spaced relation therewith, and respective inlet and outlet means provided for said vessel and sleeve to accommodate the flow of vapor therethrough, said inlet means being subjacent to the outlet means, the sleeve including a perforated upper segment defining the outlet therefrom, a fixed cone-shaped deflector extending into at least a portion of the perforated segment and forming a closure over the top of said sleeve, and a lower segment of said vessel and sleeve being formed with a plurality of spaced openings fitted with fixed nozzle means for upwardly injecting a cooling fluid within the sleeve for mixing with the vapor to regulate the temperature thereof.

2. The attemperator according to claim 1 wherein the horizontal cross-sectional area of the upper segment is smaller than that of said lower segment.

3. The attemperator according to claim 2 wherein said upper and lower segments are joined by a frusto-conical transition member.

4. The attemperator according to claim 1 wherein the sleeve inlet means includes a frusto-conical member divergent in the direction of vapor flow.

5. The attemperator according to claim 1 wherein said nozzle means are provided with upwardly oriented discharge orifices disposed adjacent the sleeve inner periphery.

6. The attemperator according to claim 1 wherein the vessel outlet is subjacent to said sleeve outlet.

7. The attemperator according to claim 1 including plate means forming a plurality of axially spaced annular drip ledges fixedly connected to said deflector.

8. The attemperator according to claim 1 including plate means forming at least one drip ledge projecting outwardly from said deflector.

9. The attemperator according to claim 8 wherein said ledge is of annular configuration and forms an upright skirt surrounding an intermediate portion of said deflector.

10. The attemperator according to claim 9 wherein said ledge is formed with bevelled end faces.

* * * * *